United States Patent [19]

Walsh

[11] Patent Number: 4,749,135

[45] Date of Patent: Jun. 7, 1988

[54] PEANUT GRINDING APPARATUS

[75] Inventor: David E. Walsh, Fargo, N. Dak.

[73] Assignee: General Nutrition, Inc., Pittsburgh, Pa.

[21] Appl. No.: 415,330

[22] Filed: Sep. 7, 1982

[51] Int. Cl.[4] ..... B02C 7/04

[52] U.S. Cl. ..... 241/247; 241/259.1; 241/261.3; 241/296

[58] Field of Search ..... 241/247, 248, 250, 259.1, 241/261.3, 296, 261.2

[56] References Cited

U.S. PATENT DOCUMENTS

| | | | |
|---|---|---|---|
| 485,854 | 11/1892 | Woodruff | 241/247 |
| 3,982,704 | 9/1976 | Palyi | 241/298 |
| 4,201,349 | 5/1980 | Walsh | 241/247 |

FOREIGN PATENT DOCUMENTS

| | | | |
|---|---|---|---|
| 274897 | 6/1914 | Fed. Rep. of Germany | 241/247 |
| 467878 | 12/1951 | Italy | 241/296 |

*Primary Examiner*—P. W. Echols
*Assistant Examiner*—Joseph M. Gorski
*Attorney, Agent, or Firm*—Parmelee, Miller, Welsh & Kratz

[57] ABSTRACT

A motor-driven nut-grinding apparatus is constructed to effectively operate at much lower than conventional speeds and has a front-mounted, unitary casting part providing a back mounting plate wall, a feed chute, a forwardly extending feed and grinding hub, and a front mounting for a stationary grinding disc. The hub has an open-end bore that journals a motor-driven auger shaft on which a rotating grinding disc is mounted to cooperate and define a final grinding chamber with the stationary grinding plate. A back portion of the auger shaft has a cylindrical, reduced diameter portion that with at least about one and a half of auger convolution turns, is exposed through a window in the hub and an open mouth of the chute to provide a non-jamming receiving area for nut kernels from a downwardly converging mouth portion of the feed chute. The length of the cylindrical portion is sufficient to freely receive nuts or kernels lengthwise thereon for non-interrupted feed delivery of a full charge of nut material to worm convolutions of the auger shaft. The hub and auger shaft provide a preliminary or rough grinding action and the pair of grinding discs provide a final, fine grinding action on the nut material.

4 Claims, 3 Drawing Sheets

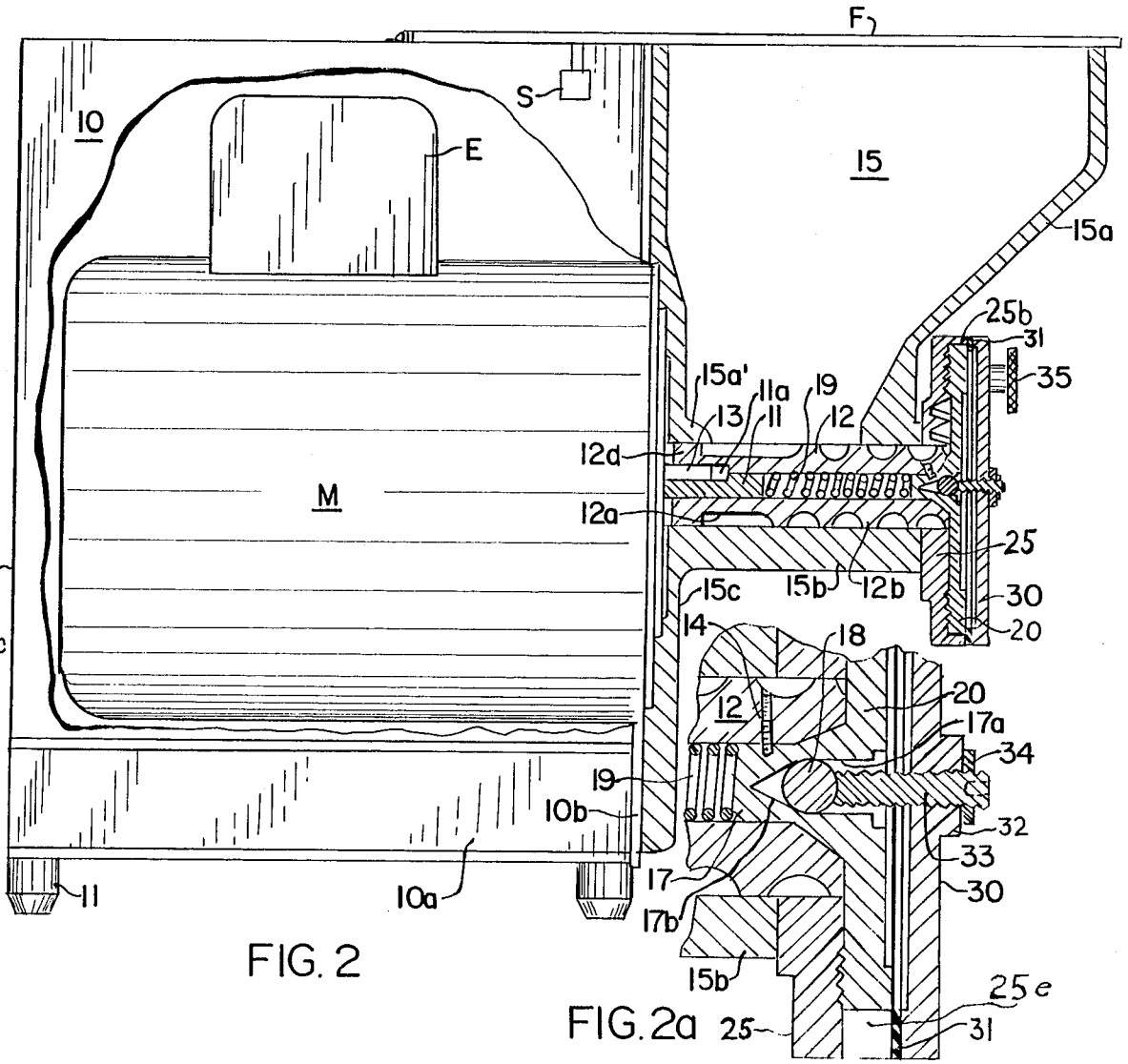
FIG. 2a
FIG. 2
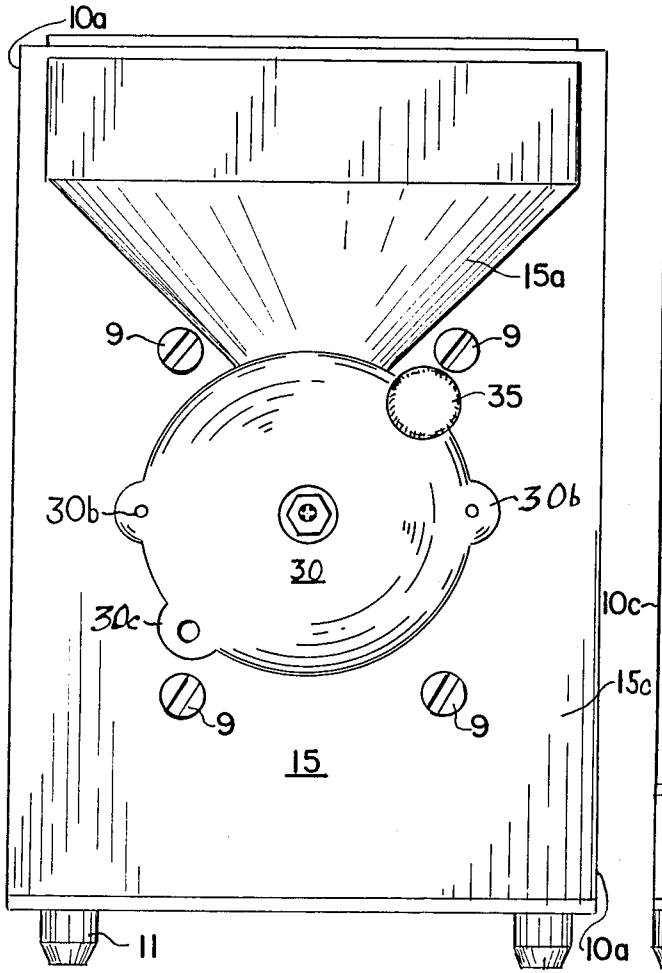
FIG. 1

PEANUT GRINDING APPARATUS

BACKGROUND OF THE INVENTION

The present invention pertains to a refining apparatus for fresh grinding of nut and grain kernels that is fully non-jamming or clogging, and that enables a non-interrupted, continuous, high-powered outflow of a fully uniformly textured butter or meal.

The apparatus represents an improved construction of a general type of machine such as disclosed in my earlier U.S. Pat. No. 4,201,349. Although such a machine has been successful in its operation, I have found that there has been a need for improving the efficiency of operation from the standpoint of enabling an increase in power drive, of positively preventing a tendency of nuts or kernels to build-up and jam at the bottom of the feed chute, and of enabling an un-interrupted continuity of delivery of the processed meal or butter with a complete and full uniformity of its as-ground texture. I have found that there has also been a need for improvement from the standpoint of facilitating assembly and disassembly of the operating elements for cleaning them.

Other constructions with which I am familiar are represented by the Fuller U.S. Pat. No. 4,027,824 and Boothe U.S. Pat. No. 4,085,899. The Fuller patent shows an early type of apparatus whose auger shaft has its lands extending along the full bottom opening of the feed chute and utilizes cooperating, relatively coarse, final grinding teeth on a pair of blades that outwardly converge and inwardly diverge with respect to each other. The product obtained may be termed "rough ground". The Boothe patent is impractical for food or nut grinding, in that it provides a large open space or chamber between the end of its delivery chute and its auger shaft, and utilizes a pair of grinding discs that are widely spaced-apart and have screen, mesh-like surfaces or cross-hatched channels that do not provide effective paths of movement of the material and pose a cleaning problem.

An object of the invention has been to meet adverse factors heretofore encountered in the grinding of food in the nature of nuts or grain kernels.

Another object has been to provide a machine that will be simple and efficient in its operation and that will assure a minimum of and ease of maintenance.

Another object has been to solve the problem heretofore presented from the standpoint of throw-back, backing-up or jamming of nuts or kernels at the point of delivery of the feed chute to an advancing auger shaft.

A further object has been to devise an apparatus that has a final grinding tooth arrangement devised to positively assure a full uniformity of texture of processed butter, meal or flour-like product.

A still further object has been to provide a machine that can be effectively operated at a relatively slow, high-powered drive speed, and that will assure a substantial, continuous feed of uniformly completely ground meal or butter.

These and other objects of the invention will appear to those skilled in the art from the embodiment herein set forth and described and from the claims.

BRIEF DESCRIPTION OF THE DRAWINGS

FIG. 1 is a front end view in elevation of apparatus embodying the invention;

FIG. 2 is a side view in elevation of the apparatus of and on the same scale as FIG. 1; it is partially broken-out as to its motor containing housing and sectioned, as to its front operating end portion;

FIG. 2*a* is an enlarged fragmental side section in elevation showing details of mounting and adjustment means for cooperating grinding discs of the machine of FIG. 2;

Figure 10:
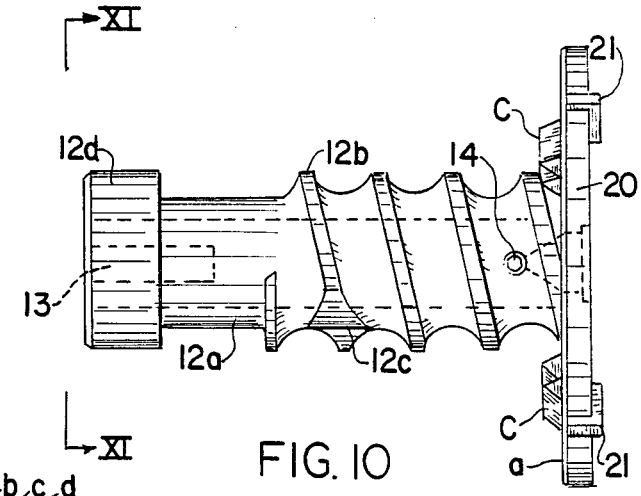
FIG. 10 is a side view in elevation on the same scale as FIG. 9, showing the rotatable grinding disc in a mounted relation on the front end of an auger shaft of the apparatus.
Figure 11:
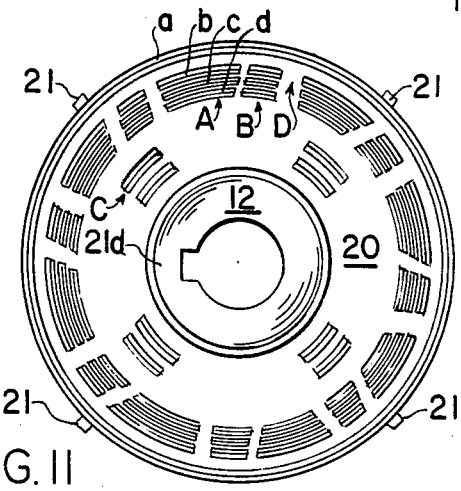

And, FIG. 11 is a back end view on the same scale as and taken along the line XI—XI of FIG. 10; this view particularly shows the construction of an inner grinding face of the rotating grinding disc with its curved cutting rib or teeth groups and importantly, with a final, continuously circular cutting tooth adjacent its outer periphery.

DETAILED DESCRIPTION

Figure 4:
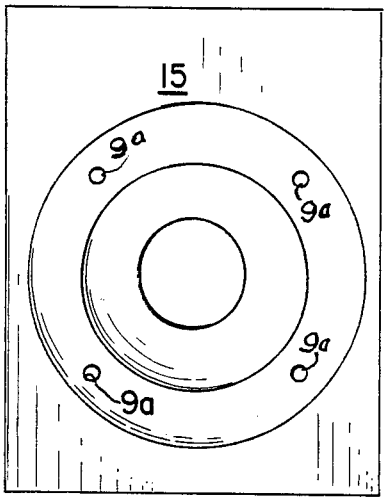
FIG. 4 is a back end view on the same scale as FIG. 3 showing only the unitary casting, also with the auger shaft removed.

Referring particularly to FIGS. 1, 2 and 2*a*, an electric motor M is shown provided with a drive shaft 11, and mounted within an enclosed casing or housing 10. The motor M is shown provided with a capacitor E, and an automatic, lid-energized switch S that may be connected in a conventional circuit, such as illustrated by FIG. 4 of my U.S. Pat. No. 4,201,349. As shown in FIG. 2, the switch A is positioned so that it will be opened when a hinged lid F has been raised to inspect or fill a feed chute portion 15*a* of a front mounted, unitary part or casting unit 15, and to close its electrical circuit and permit energization of the motor M when the lid F is swung to the closed position shown.

It will be noted that motor-enclosing casing or housing 10 has a pair of upright side walls 10*a*, a front wall 10*b*, and a back wall 10*c*. The casting unit 15 is adapted to be removably mounted by threaded screws or bolts 9 that extend through holes 9*a* in the casting 15 (see FIGS. 1 and 4), and within aligned threaded holes in the front wall 10*b*. Among other things, making the part 15 a unitary member which has a downwardly converging feed chute portion 15*a* and a forwardly extending hub portion 15*b*, assembly and disassembly of operating parts of the machine is facilitated. The lower end of the feed chute portion 15*a* has an open mouth provided with a back, slightly overhanging inside lip 15*a'* (see FIG. 1) which serves to discharge the peanuts or other kernels directly into a smooth, cylindrical, reduced diameter portion 12*a* of an auger shaft 12. The lip 15*a'* also serves to journal a back end collar portion 12*d* of the auger shaft 12; its permits endwise adjustment of the auger shaft 12 without exposing the collar 12*d* to the open mouth portion of the chute 15.

The auger shaft 12 is rotatably mounted to extend longitudinally forwardly within a central bore of the hub portion 15*b*. The shaft 12 has an open-end, central bore there-along to fit over the forward end of a drive shaft 11. Rectangular keyway slot portions 11*a* are defined between the shaft 11 and the auger shaft 12 within which a rectangular key 13 is slidably positioned. The key 13 is of shorter length than the length extent of the slot portions 11*a* to enable relative endwise adjustment movement between the auger shaft 12 and the motor drive shaft 11; it provides the auger shaft with a rotatable driven relation. A tension spring 19 is positioned within the front portion of an open-end bore in the auger shaft 12 to abut the forward end of and to resiliently position the auger shaft 12 in its forwardly extending, endwise relation with respect to the motor drive shaft 11.

As shown particularly in FIGS. 2 and 2*a*, the back end collar 12*d* of the auger shaft 12 is of an enlarged diameter which corresponds to the inner diameter of the bore hole within the hub portion 15*b*. Adjacent material entry portion 12*a* of the auger shaft 12 is of reduced diameter and has a smooth, cylindrical shape and a length that is exposed to the open feed mouth of the chute 15 that is at least equal to the maximum length of the kernels or nuts to the ground; such length may normally be about one and one eighth of an inch, taken between the collar 12*d* and the starting portion of convolutions or lands that extend in an advancing-turning relation along a worm portion 12*b* of the shaft to its end. It will be noted that the diameter of the cylindrical entry portion 12*a* corresponds substantially to the depth of the grooves between convolutions of the worm portion 12*b*.

Continuous, forwardly advancing, convoluted worm portion 12*b* extends from the reduced portion 12*a* and has about one to two turns exposed to the open mouth of the feed chute 15*a*. Such exposed length may normally be about one inch. The use of the cylindrical portion 12*a* along with a starting portion of the convoluted worm portion has been discovered to be important in achieving a slow speed power type of operation (in the neighborhood of about 900 r.p.m.), and also, a non-interrupted, continuous, non-jamming type of operation from the standpoint of a full charge of nut or grain kernel material. A substantially equal feed mouth exposed length of the cylindrical portion 12*a* and of the worm portion 12*b* has been found to be satisfactory. That is importantly, the length extent of the reduced diameter cylindrical portion 12*a* is at least equal to and preferably slightly greater than the length or longest dimension or extent of the nuts or kernels that are to be ground. The proportioning of this portion 12*a* with the starting of the lands 12*b* with reference to the converging open feed mouth of the chute 15 assures that the nuts or kernels will freely fall into the space provided without jamming the feed opening to cause a build-up and an interruption of the feed during the grinding operation. The construction assures a foolproof, uniform, uninterrupted type of feed, irrespective of whether the nuts or kernels enter the spacing provided between the bore of the hub portion 15*b* and the surface of the cylindrical portion part 12*a*, endwise, crosswise or lengthwise thereof.

With reference to FIG. 10, cut-out step or ledge portion 12*c* is located within the open area of the mouth of the chute portion 15*a* to serve as an initial breaker step or offset ledge and, in this connection, furthers the function of the cylndrical portion 12*a* from the standpoint of assuring a constant, uninterrupted feed and advance of the nuts or kernels without blockage.

Figure 3:
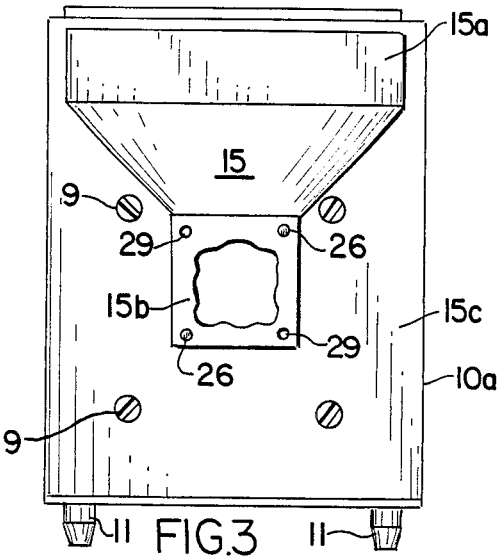
FIG. 3 is a reduced front end view of the apparatus of FIGS. 1 and 2, showing its unitary casting mounted on the motor housing and the exposed front end of its extending hub portion with an auger shaft removed.
Figure 6:
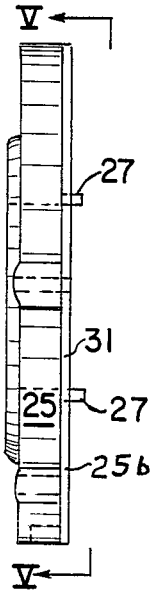
FIG. 6 is an edge view in elevation showing the fixed grinding disc of FIG. 5 in an unmounted relation.
Figure 5:
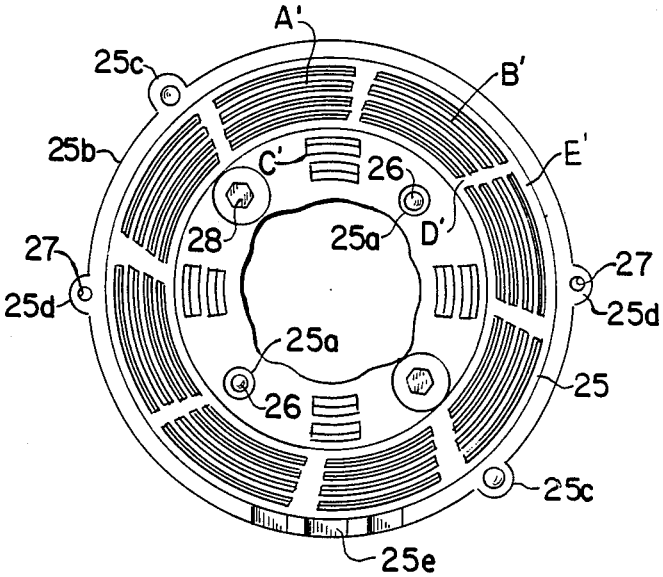
FIG. 5 is an enlarged front end view taken along the line V—V of FIG. 6, showing a fixed or stationary grinding disc, plate or head in a mounted relation on the front end of the hub portion of the unitary casting; this view illustrates the construction of finer and coarser, fragmental curved cutting rib or teeth group assemblies or sets that are carried on the inner or front face of the fixed grinding disc.

A fixed grinding blade, disc or head 25, see particularly FIGS. 2*a*, 5 and 6, is shown removably secured on the front end or face of the hub portion 15*b* of the unitary casting part by a pair of Allen head screws 28 that screw into threaded bores 29 in the front face or end of the casting hub 15*b*. Its quick removal and insertion in a proper relation is facilitated by a pair of alignment or guide pins 26 (see FIGS. 3 and 5) which are adapted to align with and extend into a pair of holes 25*a* through the inside wall portion of the fixed grinding disc 25.

As particularly illustrated in FIG. 5, the fixed or stationary grinding disc 25 has four, quadrant-positioned, inner groups, sets or pairs or relatively coarse and short-length grinding teeth or cutting rib pairs C' that extend from the inside face thereof. Also, as shown, sets or groups of finer outer teeth A' and B' are provided of which each has four, radially spaced-apart cutting ridges or teeth segments that are positioned to extend from its inner face. The outer sets A' and B' have a radially outwardly spaced relation with respect to the coarser teeth sets C', and the coarser sets C' are positioned in alignment with open, radial gutters or spaces D' between each two adjacent pairs of finer, more closely spaced outer teeth A', B'. The relatively wide spacing of the inner, coarser teeth sets C' is followed by relatively narrow, open-spaces or gutters D' that extend radially outwardly into a continuous, circumferential, outer spacing or gutter E' that is surmounted by a raised, continuous, peripheral mounting rim or flange 25*b*.

Figure 7:
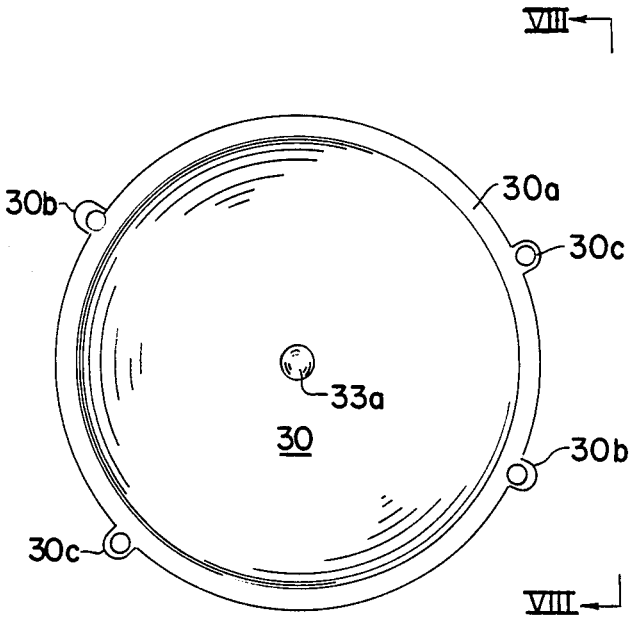
FIG. 7 is an inside end view of a cover plate or end cap for the grinding disc assembly of the apparatus in an unmounted relation, but with an adjustment screw mounted in its threaded, centrally located boss.

The peripheral rim 25*b* has a pair of diagonally oppositely positioned tabs 25*c* that are provided with threaded holes therein to receive mounting thumb screws 35 that extend through holes in a pair of mounting tabs 30*c* of a cover plate or end cap 30 (see FIGS. 1, 2 and 7). A second pair of diagonally opposite tabs 25*d* carry projecting alignment or guide pins 27 (see FIGS. 5 and 6) that are adapted to fit within the holes in a second pair of tabs 30*b* carried by end cover plate or cap 30.

A rotatable grinding disc or plate 20 (see FIGS. 10 and 11), also has four, quadrant-positioned groups or sets of coarse grinding teeth or cutting ridges C, of which each has two, short-length teeth in a radially spaced relation. Outer finer sets or groups of teeth A and B have three lines of radially spaced-apart, relatively fine teeth b, c and d and are separated by radial spaces, gutters or channels D therebetween. An outer, peripheral tooth or blade a on the same inner face of the grinding disc 20 has a continuous or un-interrupted circular cutting edge to which the radial channels or spaces D feed the material. This tooth a is adapted to cooperate with a peripheral space between the outermost teeth of the finer groups A' and B' of the fixed or stationary disc 25. It provides and assures a fully or completely uniform texture of the material as it leaves the guiding chamber between the fixed disc 25 and the rotatable disc 20 before it moves forwardly over the peripheral edge of the rotatable disc 20 into a front feed chamber defined between the disc 20 and the end cap 30.

As shown particularly in FIGS. 2, 2*a* and 10, the rotating disc 20 has a back end portion that fits within a short-length, mounting stub or hub portion 17 that is adapted to fit within the front end of the bore in the auger shaft 12 and to be removably secured thereto by Allen head set screw 14. The mounting stub portion 17 has a front entry, cylindrical bore 17*a* that terminates in a cone-shaped bore 17*b* that is adapted to enclose and contain an adjustment ball 18. It is important to make the bore 17*a* of a sufficient depth such that the ball 18 will normally be positioned fully within its depth extent, so that it will not immediately fall out when the construction is disassembled for cleaning purposes, for example.

A fully threaded, Allen-end adjustment screw 33 is threaded centrally through a bore 33*a* in the end cover cap 30 (see also FIG. 7), and has a concave back end portion that corresponds in curvature to the curvature of the ball 18 against which it is adapted to seat or rest. Inner and outer movement of the threaded stem 33 will cause movement of the auger shaft 12 longitudinally with respect to the fixed grinding disc 25 and within the hub portion 15*b* to adjust the operating spacing between the opposed grinding faces and the complementary interfitting teeth of the fixed grinding disc 25 and the rotating disc 20. The construction assures an aligned adjustment of the disc 20 as well as of the auger shaft with respect to the motor drive shaft 11, and enables an adjustment of the spacing between opposed, complementarily interfitting cutting teeth of the fixed disc 25 and the rotatable disc 20.

Incidentally, in the operation of the device, with the shown direction of turns on the auger shaft 12, the feed of the roughly ground material, as accomplished by the lands and grooves, will be effected by its counterclockwise rotation. The broken up and roughly ground material is introduced from the front end of the auger shaft 12 through a central feed input opening in the fixed grinding disc 25 into a central chamber area or spacing between the grinding discs 20 and 25, then radially outward from between complementarily interfitting, relatively coarse, short length, widely spaced-apart, circumferentially curved teeth segments C and C', between open, space-defining faces, between relatively fine, greater length, circumferentially curved teeth segments A, B, A' and B', along relatively narrow open radial spaces D, D' therebetween, and radially over continuous, outer rim tooth portion a of the rotatable disc 20, forwardly into the front end chamber defined between a substantially planar front face of the rotating grinding disc 20 and a slightly forwardly spaced, planar back face of the end cover plate or cap 30.

Figure 9:
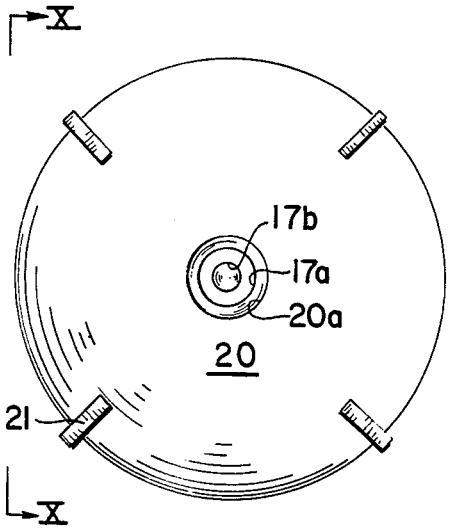
FIG. 9 is an outer or front end view in elevation on the same scale as FIGS. 5 and 7, showing the construction of a rotatable grinding disc or plate of the apparatus.

As shown in FIG. 7, the cover plate or cap 30 has a slightly inwardly offset mounting rim portion 30*a*. Wiping knives or blades 21 (see FIG. 9) project both radially outwardly and forwardly at quadrant locations from the outer periphery and the front face of the rotating grinding disc 20. Fully, finely and uniformly fine textured meal or butter is passed downwardly and outwardly through exit spaces or openings 25*e* (see FIGS. 2*a* and 5) that extend through the bottom portion of the rim 25*b* of the stationary grinding disc 25.

Figure 8:
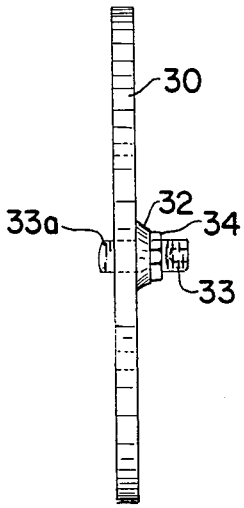
FIG. 8 is an edge view on the same scale of and taken along the line VIII—VIII of FIG. 7; in this view, details of the adjustment screw mounting are shown.

Adjustment screw 33 extends from a front boss portion 32 of the cover plate 30, see particularly FIGS. 2*a* and 8 and is secured in an adjusted position by lock nut 34. A front end of the screw 33 has an Allen head, tool-receiving bore therein.

As previously indicated, the auger shaft 12 has a special type of cooperation with the converging delivery end of the feed chute 15*a* and is so constructed that it will eliminate any tendency for them to jam at the receiving end of the auger shaft 12. The construction is foolproof in preliminarily breaking up or grinding of nut bodies as they are presented from the chute 15*a*. The speed of operation now can be reduced from a normal speed of about 1600 r.p.m. to an increased power driving speed of about 900 r.p.m., without any tendency to throw the nuts back at the delivery end of the chute 15*a* and with an increased output of a fully uniformly ground meal or butter-like product.

I claim:

1. A grinding apparatus for continuously processing a full charge of nut or grain kernel material to produce a food meal or butter of uniform and fine texture which comprises, an electric motor having an extending drive shaft, an enclosing housing for said motor, a unitary part having a feed chute terminating in a forwardly extending hollow hub, said feed chute having a converging wall that has a bottom mouth portion open to said hub, a rough grinding auger shaft rotatably mounted to extend forwardly along and within said hub in a driven relation with respect to said drive shaft, a fixed grinding disc having an axial feed opening therein to receive rough ground material being fed forwardly from said mouth portion by said auger shaft, a rotatable grinding disc in a forwardly mounted cooperating relation with said fixed grinding disc and being secured on a front end portion of said auger shaft to define a grinding chamber between it back face and an opposing front face of said fixed grinding disc, an end cover cap positioned over said rotatable disc and removably secured in position to said fixed disc to define a front chamber between its back face and a front face of said rotatable disc, outfeed means open through a bottom portion of said fixed disc to deliver fully processed material from said front chamber, the front face of said fixed grinding disc and the back face of said rotatable grinding disc each having inner groups of relatively coarse teeth projecting therefrom in a circularly extending and a circumferentially spaced relation with respect to each other and having outer groups of finer teeth in a circularly extending and circumferentially spaced relation with respect to each other, said outer groups being in a radial outwardly spaced relation with respect to said inner groups to receive material from said inner groups that is being introduced through said central axial feed opening, the groups of coarse and finer teeth of said fixed and rotatable discs being in an opposed complementary interfitting relation with respect to each other; said rotatable disc being adapted to advance the material radially outwardly between the opposed faces, to progressively reduce its granular texture to a final product, and to then advance the product forwardly over the peripheral edge of said rotatable disc into said front chamber and outwardly through said outfeed means, said fixed disc having a rim on which said end cover is mounted, said rim defining a continuous circular space between it and its outer groups of finer teeth, and said rotatable disc having a circular fully continuous cutting tooth blade extending along its back face adjacent its outer periphery that is adapted to be rotated within said continuous circular space of said fixed disc to provide finalized fully uniformly ground material.

2. A grinding apparatus as defined in claim 1 wherein each group of finer teeth of one of said grinding discs has an even number of radially spaced-apart teeth thereon, and each group of finer teeth of the other of said grinding discs has an odd number of radially spaced-apart teeth in a cooperating complementary opposed relation with respect to each group of finer teeth of the one disc.

3. A grinding apparatus as defined in claim 1 wherein, said circular fully continuous cutting blade of said rotatable disc is spaced outwardly with respect to the groups of finer teeth of said rotatable disc by a continuous circular spacing, and the groups of finer teeth of said fixed and rotatable discs have radial spacing therebetween whose outer ends are connected to said continuous circular spacing.

4. A grinding apparatus as defined in claim 1 wherein, said auger shaft has a back end collar journaled within said hollow hub for rotatable operation therewith, said auger shaft has a reduced diameter cylindrical portion extending from said collar along said bottom mouth portion substantially half-way therealong and terminating in a worm portion having convolutions, a valley open to said cylindrical portion and extending in an advancing relation therefrom along and between said convolutions to a front end of said auger shaft, said valley along its length being of substantially the same diameter as said cylindrical portion, said convolutions extending forwardly from said cylindrical portion and at least about one and one-half turns along said bottom mouth portion, an initial portion of said convolutions located within an open area of said bottom mouth portion having a cut-out ledge portion to define an initial breaker ledge for the nut material being fed from the feed chute to assure a constant and uninterrupted feed of the material without blockage along said auger shaft.

* * * * *